United States Patent [19]

Hart

[11] Patent Number: 4,930,236

[45] Date of Patent: Jun. 5, 1990

[54] PASSIVE INFRARED DISPLAY DEVICES

[76] Inventor: Frank J. Hart, 2811 Mark Ave., Santa Clara, Calif. 95051

[21] Appl. No.: 277,203

[22] Filed: Nov. 29, 1988

[51] Int. Cl.[5] ..... G09F 19/02

[52] U.S. Cl. ..... 40/414; 40/455; 40/463; 340/692; 446/175

[58] Field of Search ..... 446/175, 14; 40/414, 40/411, 455, 456, 465, 466, 463; 540/692, 522, 523

[56] References Cited

U.S. PATENT DOCUMENTS

| | | | |
|---|---|---|---|
| 2,152,296 | 3/1939 | Weis et al. | 40/457 |
| 2,924,909 | 2/1960 | Williams | 40/411 X |
| 4,662,854 | 5/1987 | Faug | 446/175 |
| 4,717,363 | 1/1988 | Refabert | 446/14 |
| 4,737,131 | 4/1988 | Sirota | 446/130 |
| 4,772,875 | 9/1988 | Maddox et al. | 340/522 |
| 4,799,459 | 1/1989 | Yi-Tung | 446/175 X |
| 4,828,525 | 5/1989 | Okano | 446/175 |

*Primary Examiner*—James R. Brittain

*Attorney, Agent, or Firm*—Richard C. Litman

[57] ABSTRACT

An advertising and display device includes apparatus to provide automation so as to interact with persons in the area by means of passive infrared sensing devices. The advertising and display device may take the form of a rotating platform or representation of a being or animal, and may incorporate an audio message delivery system also activated by the physical proximity of persons detected by the infrared sensors. The sensing system may be remotely located to enable the advertising and display device to be placed within an enclosure such as a showroom window, etc., and the display platform may incorporate a photoelectric detector to temporarily stop the drive system when a person is in extremely close proximity in order to allow that person to more closely examine items located on the platform.

10 Claims, 3 Drawing Sheets

PASSIVE INFRARED DISPLAY DEVICES

FIELD OF THE INVENTION

This invention relates generally to mechanized advertising or display devices, and more specifically to such devices controlled by infrared sensors so as to interact with persons in the immediate area.

BACKGROUND OF THE INVENTION

The advertising field is highly competitive, and a multitude of devices have been developed over the years in attempts to catch the eye or ear of the potential consumer; there has been a constant effort to develop devices incorporating attractive colors, sounds, and odors. Those involved in the industry are aware that movement attracts and holds the eye of the consumer more efficiently than other methods and advertising devices which do not incorporate movement. Well known in the art are the simple forms of flags, pennants and banners to the more sophisticated complex mechanical and/or electronic devices.

Typically, such mechanized devices have consisted of motorized, revolving or oscillating displays or figures. Tully, U.S. Pat. No. 382,445 and Littleton et al., U.S. Pat. No. 326,997 disclose early forms of such devices. The major disadvantage of these prior devices, however, is that the movement is constant, without variation so long as power is applied to the display. The typical person quickly becomes bored with such simple action and may not spend the time necessary to absorb the advertising message. Weiss et al., U.S. Pat. No. 2,152.296 discloses a manikin wherein operation is activated by the proximity of a person in the vicinity of the apparatus, but the activating means (pressure sensitive floor switch active photoelectric detectors, or the like) merely serves to start and stop the device,. Once again, the movement of such a device is predetermined, and moreover, such means of activation may be triggered by other than human presence. This leads to unnecessary wear and tear on the mechanism.

Clearly a device which truly interacts with human presence by self activation, following by movement, and deactivation according to the proximity and movement of persons, is a desirable advancement in the art as it retains the attention and interest of consumers for a longer period of time. Therefore, such a device will more effectively deliver an advertising message of display to consumers. A passive infrared detection system in combination with such movable displays is a significant improvement in the state of the art. While passive infrared systems have been developed for the purpose of surveillance and intrusion alarms and are generally known in the art, typically these devices encompass a relatively large field of view (some 90° degrees) and are mounted in a corner of a room or enclosure so as to survey the entire area, such devices are unsuitable for the relatively narrow field of view necessary to focus on a single person located at the front of the display. These systems use a relatively complex system of mirrors and/or sensors to cover wide field of view. What is needed is a device specifically designed and constructed to detect and interact with the presence of a single person or small group of persons in a relatively small angular field of view.

SUMMARY OF THE INVENTION

Accordingly, it is an object of the present invention to provide as improved advertising display device activated and controlled by the physical proximity of persons by means of passive infrared detecting devices.

It is another object of the present invention to incorporate such a system in a manikin, movable in its entirety or portions thereof, thereby simulating the action of a person interacting with other persons.

It is yet another object of the present invention to incorporate such a system in various characterizations of animals or beings, either actual or mythical.

It is a further object of the present invention to incorporate such a system in various mechanized devices, such as display tables and/or cases, so as to allow such exhibits to be most effectively displayed to potential consumers by interacting with their presence.

It is an additional object of the present invention to provide for the remote installation of such passive infrared sensing devices, along with their associated electronic circuitry, so as to allow the mechanized device to be installed within an enclosed area, separated from persons by a transparent partition such as a window, etc.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
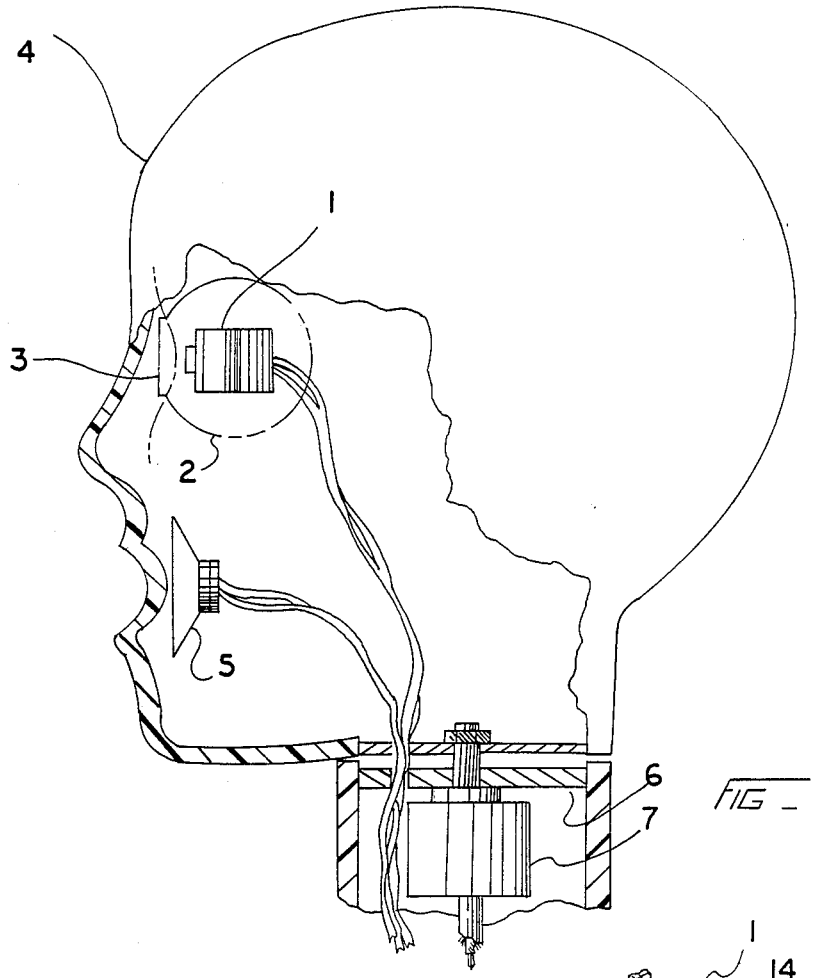
FIG. 1 is a side view of the head of a human figure or manikin, disclosing some of the various components of the present invention.

Referring to the drawings, the present invention will be understood to relate to a means of controlling the interactive movement of an advertising and display device, figure or the like through the use of passive infrared sensing devices and the proper associated electronic circuitry and devices. FIG. 1 discloses a passive infrared sensing device 1 mounted in an eye socket 2 of the head 4 of a human figure or manikin 8 of FIG. 2. The infrared sensing device 1 may be situated behind a lens 3 to properly focus the infrared energy, or may be remotely located from the head 4 in another area of the body of the manikin 8, or external to the manikin 8 in order to operate the manikin 8 when such manikin 8 is located within an enclosed area. Head 4 may also contain a speaker 5 in order to simulate a voice, or such speaker 5 may be located in another area of manikin 8 or remotely located when manikin 8 is located within an enclosed area. Head 4 is attached to a mounting bracket 6 which is attached to a stepper motor 7, thereby allowing rotational movement. One or more limiting switches, not shown, may be used to determine the neutral position of the above assembly 1 through 7. An additional motor, not shown, may be connected to the passive infrared sensors 1 so as to simulate eye movement when such sensors are located in the eyes of manikin 8.

Figure 2:
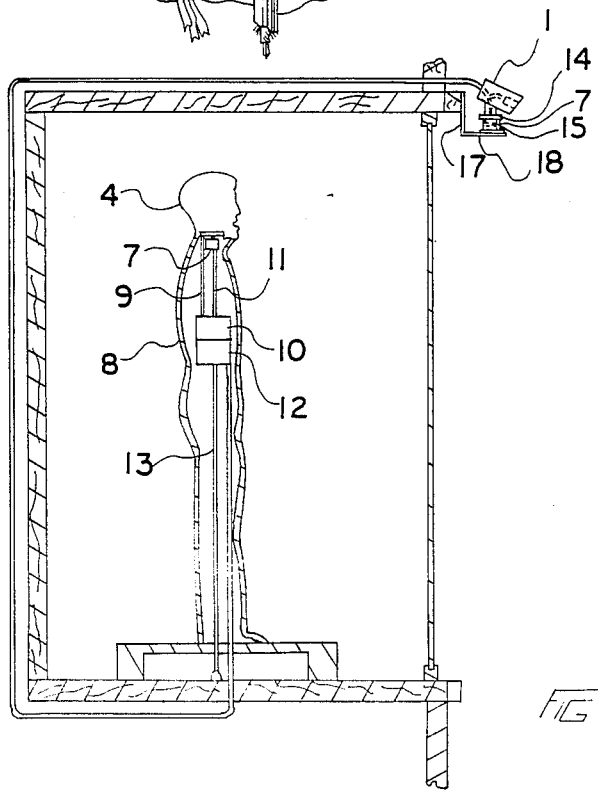
FIG. 2 is a side elevation, partly in section, of a human figure or manikin, further disclosing additional components therein, and the remotely situated interactive display device necessary to operate such a figure when installed within an enclosed area.

In FIG. 2 of the drawings the above assembly 1 through 7 is shown attached to manikin 8. The body of manikin 8 contains electronic circuitry and components consisting of a cable 9 to convey the signal from the passive infrared sensing device(s) 1 to the signal processing circuitry contained in circuit board 10. A cable 11 conveys the resulting signal from circuit board 10 to stepper motor 7. An audio playback device 12 operated by circuit board 10 and powering speaker 5 may also be installed. Electrical supply cord 13 passes through the torso of manikin 8 and is connected to a suitable electrical power source. The present invention may also be supplied with electrical power from a variety of sources, such as electrical storage batteries or other electrical power, with appropriate modification to voltage and/or amperage levels, through transformers and/or other electrical devices as necessary. FIG. 2 of the drawings also discloses a side elevation view of a remotely situated controller to operate display devices located within an enclosed area, separated from persons by a transparent partition. Such a controller is of course only used in circumstances in which the device which it is controlling is remotely located from such a controller. Passive infrared sensors 1, identical to those in other figures, are located on a table or remote device 14 which is rotated by a stepper motor 7, identical to those in other figures, controlled by a microcontroller and motor driver 15 which serves the same function as circuit board 10 in this figure. In an alternative system, the passive infrared sensors 1 may be stationary and detect the direction of movement of persons by means of a fresnel lens array, not shown. In either system, a microcontroller 15 within the remote device 14 translates the signals from the passive infrared sensors 1 and sends the translated information in the form of commands to the microcontroller in manikin 8 via an RS-232 serial port, not shown. The remote device may be installed using a wall plate 17 or base plate 18 or other equivalent means.

Figure 3:
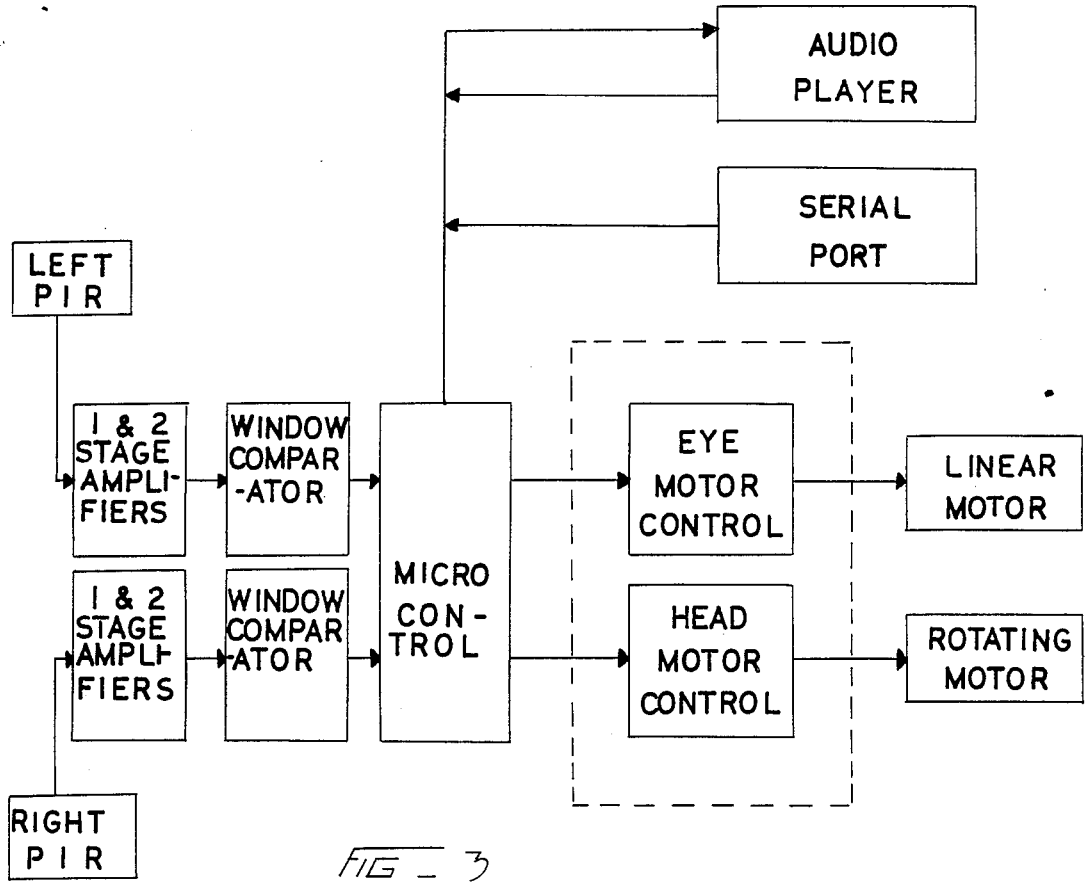
FIG. 3 is a block diagram of the electronic circuitry used in the invention, including features which may be used in directly or remotely controlling a manikin or other figure.
Figure 4:
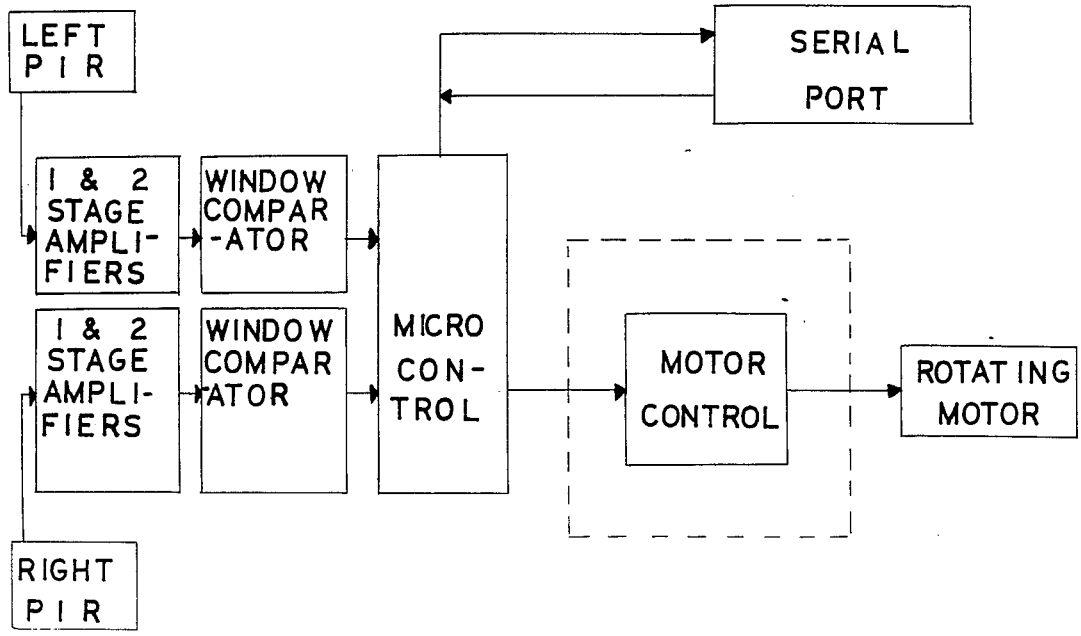
FIG. 4 is a block diagram similar to that of FIG. 3, of the electronic circuitry used in actuating a display device.

FIGS. 3 and 4 of the drawings disclose the basic electronic circuitry and components employed in order to interpret the signals from the passive infrared detectors 1 and operate the present display devices. No claim is made for any of the components individually as they are well known in the art.

Figure 5:
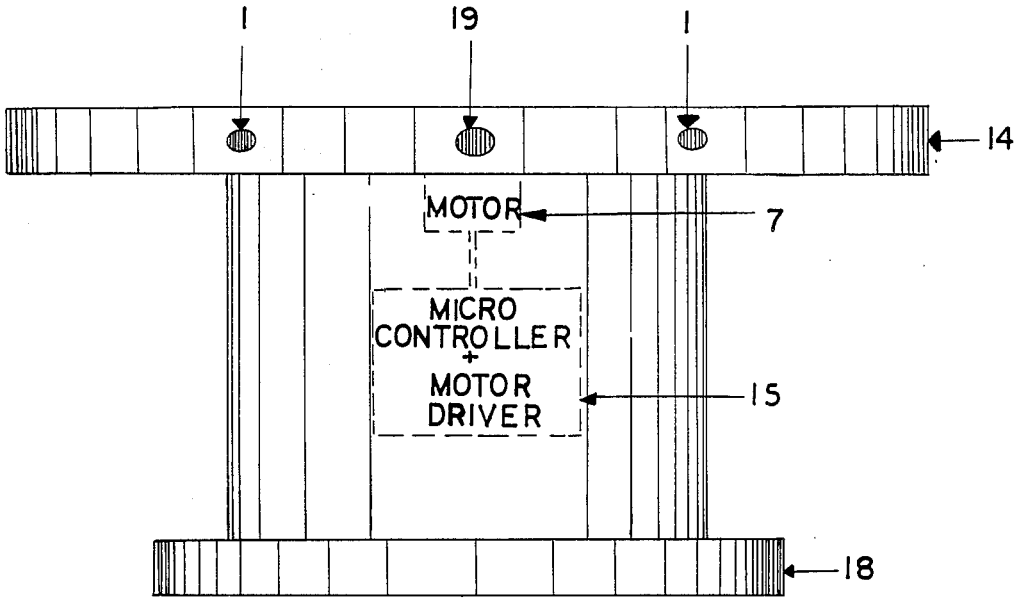
FIG. 5 is a front elevation of an interactive display table disclosing a block diagram of the electronic components therein.

FIG. 5 of the drawings discloses an interactive display table or platform incorporating a base plate 18 upon which is located microcontroller and motor driver 15, stepper motor 7, and rotary display platform 14 in which are mounted passive infrared detectors 1 which provide information for the microcontroller and motor driver 15. In addition to the features above and those of FIG. 2, a photocell 19 is incorporated and interfaced with microcontroller and motor driver 15 so as to stop the mechanism when a person approaches to a very close proximity to further examine the display.

It is to be understood that the present invention is not limited to the sole embodiment described above, but encompasses any and all embodiments within the scope of the following claims.

I claim:

1. An automated advertising and display apparatus comprising;

a displaceable body, means operable to shiftably move said body, recognition and continuous tracking means, electronic control means interconnecting said recognition and tracking means and said displaceable body, said continuous tracking means and electronic control means functioning by repetitive sampling and testing, said recognition and tracking means including passive infrared sensing means recognizing the presence of a person within a prescribed range and field of view, Whereby such presence in said range and view actuates said operable means to move said body in a continuous tracking manner of said person.

2. An automated advertising and display apparatus according to claim 1 wherein, said displaceable body includes a platform.

3. An automated advertising and display apparatus according to claim 1 wherein, said displaceable body includes a manikin.

4. An automated advertising and display apparatus according to claim 3 wherein, said manikin includes a head, said passive infrared sensing means includes a pair of laterally spaced apart sensors in said manikin head.

5. An automated advertising and display apparatus according to claim 1 including, a transparent barrier adjacent said displaceable body, and said recognition and continuous tracking means disposed on one side of said barrier with said displaceable body disposed on an opposite side of said barrier.

6. An automated advertising and display apparatus according to claim 1 wherein said electronic control means includes a microcontroller.

7. An automated advertising and display apparatus according to claim 1 including, audio transmitting means on said displaceable body.

8. An automated advertising and display apparatus according to claim 1 wherein, said recognition and continuous tracking means includes a photoelectric detector sensing the proximity of a person to disable said operable means.

9. An automated advertising and display apparatus according to claim 1 wherein, said passive infrared sensing means includes a pair of laterally spaced apart sensors.

10. An automated advertising and display apparatus according to claim 9 wherein, said recognition and sensing means includes a photoelectric detector disposed between said pair of laterally spaced apart sensors.

* * * * *